United States Patent [19]

Melville, Jr.

[11] Patent Number: 4,485,500

[45] Date of Patent: Dec. 4, 1984

[54] GAS BINDING RESISTANT CHEMICAL DISPENSER

[75] Inventor: Douglas F. Melville, Jr., Norwood, Mass.

[73] Assignee: Knomark, Inc., Jamaica, N.Y.

[21] Appl. No.: 456,032

[22] Filed: Jan. 6, 1983

[51] Int. Cl.[3] ..... E03D 9/02

[52] U.S. Cl. ..... 4/228

[58] Field of Search ..... 4/227, 228

[56] References Cited

U.S. PATENT DOCUMENTS

| | | | |
|---|---|---|---|
| 650,161 | 5/1900 | Williams et al. | 4/227 |
| 1,175,032 | 3/1916 | Williams | 4/227 |
| 3,339,801 | 9/1967 | Hronas | 222/57 |
| 3,504,384 | 4/1970 | Radley et al. | 4/228 |
| 4,200,606 | 4/1980 | Kitko | 422/37 |
| 4,208,747 | 6/1980 | Dirksing | 4/228 |
| 4,216,027 | 8/1980 | Wages | 4/228 X |
| 4,248,827 | 2/1981 | Kitko | 422/37 |
| 4,375,109 | 3/1983 | Jones | 4/228 |

FOREIGN PATENT DOCUMENTS

| | | | |
|---|---|---|---|
| 11469 | 5/1891 | United Kingdom | 4/228 |

OTHER PUBLICATIONS

Herring–Journal of Soap, Perfumery & Cosmetics, vol. 10, pp. 426–427 (1977).

*Primary Examiner*—Charles E. Phillips

*Attorney, Agent, or Firm*—Amster, Rothstein & Engelberg

[57] ABSTRACT

A novel chemical dispenser for dispensing a predetermined volume of a chemical solution into a body of liquid, such as water in a toilet tank, in response to a change in the level of that liquid comprises (1) a container which holds the solid chemicals to be dispensed, (2) an air vent extending from the top of the container, (3) a siphon which enters the container at a point located below the top of the container and has a U-shaped bend extending above the top of the container but below the top of the air vent, and (4) a specially designed fluid communication means between the siphon and the container, which reduces or eliminates the possibility that any gas bubbles evolved by the solid chemical in the dispenser will become entrapped in the siphon and impede its normal operation.

10 Claims, 3 Drawing Figures

GAS BINDING RESISTANT CHEMICAL DISPENSER

This invention pertains to an improved method and apparatus for dispensing chemical solutions. More particularly, the present invention is directed to an improved method and apparatus for cleansing and disinfecting a flushing toilet, comprising a toilet tank and bowl, by separately dispensing cleansing and disinfecting solutions into the toilet tank during each flush cycle.

There are a wide variety of dispensers for adding chemicals to a flushing toilet which are either described in the patent literature and/or are commercially available. Various purposes are served by such dispensers. For example, surfactants may be dispensed to help keep the toilet bowl clean. Perfumes and colorants may be dispensed to provide pleasing odor and color. Strong oxidants such as hypochlorites may be dispensed to discourage microbiological growth and to inhibit staining of the toilet bowl.

U.S. Pat. Nos. 4,216,027; 4,208,747; 4,200,606 and 4,248,827 are several of a larger group of patents all of which are assigned to Procter & Gamble Company and relate to various aspects of a chemical dispenser for toilet tank use, one form of which is being sold by Procter & Gamble under the trademark "Brigade". The Brigade dispenser is designed to simultaneously dispense controlled amounts of surfactant, disinfectant, dye and perfume to a flushing toilet bowl during each flush cycle. The surfactant and disinfectant compositions and the solutions formed therefrom are disposed in separate dispenser compartments which are kept isolated from each other and from the surrounding tank water in the period between each flush so as to prevent premature mixing of these incompatible chemicals which would reduce or eliminate their effectiveness in cleansing and disinfecting a toilet bowl at the time of flushing. Isolation is accomplished by providing each dispenser with an air trap structure which causes an air bubble to form and remain disposed between the solution formed in each dispenser and the surrounding tank water. A similar air bubble may be formed on the air vent side of each dispenser compartment, or, alternatively, the dispenser may be designed in such a fashion that the air vent remains above the water line when the dispenser is disposed in a toilet tank.

The Procter & Gamble Brigade dispenser is alleged to be an improvement over the dual dispenser concept disclosed in Radley U.S. Pat. No. 3,504,384 in that the individual dispenser compartments of Radley do not provide any means for separating the bleach and surfactant solutions formed in each dispenser compartment from the surrounding tank water. The prior art does include a number of dispenser designs which provide substantial isolation between the solution formed in the dispenser and the surrounding tank water, including Williams U.S. Pat. No. 650,161; Williams U.S. Pat. No. 1,175,032; Hronas U.S. Pat. No. 3,339,801, and a number of other patents which are cited in the aforementioned Procter & Gamble patents or are otherwise known in the art. These patents have been distinguished by Procter & Gamble on the ground that they either do not provide the same degree of isolation as the dispenser structure of Dirksing U.S. Pat. No. 4,208,747, or that isolation is achieved as a result of some means other than the formation of an air bubble which physically separates the solution formed in the dispenser from the surrounding tank water.

The dispensers in the aforementioned Williams patents are true siphons in which tank water flows into the dispenser as the water level rises above the bend in the siphon pipe and, as the tank water level falls, the dispenser discharges that part of its liquid contents which is in contact with the inner leg of the siphon tube. While the structure of Williams is less complicated than the air trap structure of the Brigade dispenser, it does not result in the formation of an air bubble or provide any other means of physical separation between the solution formed in the dispenser and the surrounding tank water. Moreover, because of the internal location of the siphon tube in the Williams dispenser, it is not directly amenable to the low cost vacuum thermoforming production technique which is used to produce the Brigade dispenser.

Copending, commonly assigned application Ser. No. 456,109, filed in the names of Roger H. Doggett and Edward S. Shanley on even date herewith and entitled "Improved Chemical Dispenser" describes and claims a novel chemical dispenser in which the siphon is so constructed and located with respect to (a) the container which holds the solid chemicals and chemical solution to be dispensed, and (b) the dispenser air vent, as to provide (1) the release of a predetermined volume of chemical solution in response to a change in the level of the body of liquid in the tank in which the dispenser is disposed, (2) substantial isolation of the chemical solution in the dispenser from the surrounding tank water without the use of moving parts, air traps or air bubbles, (3) controlled mixing of fresh liquid entering the dispenser with the solid chemical and chemical solution disposed in the dispenser, and (4) a color change signal at the point in time when the solid chemical in the dispenser is substantially depleted. More specifically, the aforesaid copending application is based on the discovery that by locating the point where the siphon tube enters the dispenser at a level below the top level of the container, preferably in a deck or shoulder formed in the container for that purpose, and having the U-shaped bend in the siphon tube rise to a location which is above the top level of the container but below the top of an air vent which is also in fluid communication with the container, a predetermined volume of chemical solution can be formed and that solution will remain substantially isolated from the surrounding tank water until it is dispensed when the toilet is flushed. The entire disclosure of said copending application is hereby incorporated herein by reference. While the novel chemical dispenser of copending Doggett, et al. Ser. No. 456,109 is an improvement over prior art dispensers, it is not the optimum structure for dispensing chemicals which exhibit a tendency to form gas bubbles in solution. Such gas bubbles are known to form when strong oxidant or disinfectant materials are used in the dispenser, for example, chemicals which provide hyprochlorite ion in aqueous solution. The gas bubbles so formed can become trapped in the siphon tube and impede the proper flow of liquid into and out of the siphon.

It is an object of this invention to provide an improved chemical dispenser which is resistant to gas binding but which is otherwise capable of achieving the objects, features and advantages of the chemical dispenser described in the copending Doggett, et al. patent application Ser. No. 456,109.

It has now been discovered that any potential for gas binding in the siphon tube can be significantly reduced, if not eliminated, by arranging the location of the entry port through which fluid communication is established between the dispenser container and the siphon in such a fashion that any gas bubbles present in the chemical solution are directed upward into the air vent. More specifically, the entry port is located in a container wall which is so disposed that the entry port faces away from the solid chemicals located in the lower portion of the container. In a preferred embodiment, the entry port is located in the upper portion of a generally V-shaped indentation in the container side wall. Since gas bubbles in the chemical solution rise in a generally vertical direction, the indentation blocks the direct upward flow of the bubbles and forces them to rise in a direction which leads to the air vent rather than the siphon.

The invention will be further understood from the following more detailed description taken in connection with the accompanying drawings wherein.

Figure 2:
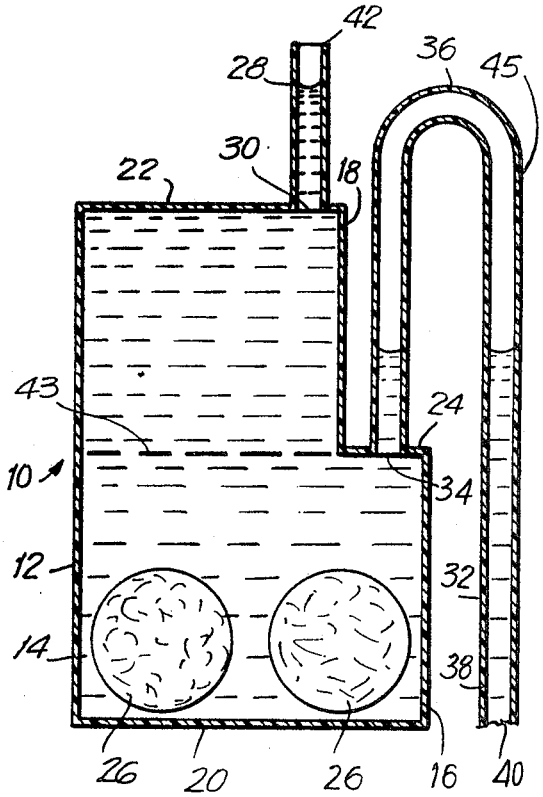
FIG. 2 is a schematic drawing of a dispenser constructed in accordance with the invention described in the copending Doggett, et al. application Ser. No. 456,109.

Referring to the drawings, FIG. 2 schematically illustrates the basic structure and operation of a single chemical dispenser 10 constructed in accordance with the copending Doggett, et al. application Ser. No. 456,109, which is designed to dispense a surfactant, colorant, disinfectant or other desired material in solution. The dispenser includes a container 12 defined by side walls 14, 16 and 18, a bottom wall 20, a top wall 22 and a deck or shoulder 24. A solid chemical 26, which is capable of forming hypochlorite ions in aqueous solution, e.g., Olin Chemical Co. "HTH" calcium hypochlorite discs or other strong oxidant material, is housed within said container 12 and rests against bottom wall 20. An air vent 28 in the form of a pipe or tube is in fluid communication with the container 12 through opening 30 in the top wall 22 thereof and extends for some distance beyond the top of the container. Siphon tube 32 is in fluid communication with the container 12 by virtue of an entry port 34 in deck or shoulder 24 of container 12. The siphon tube extends upwardly beyond the top wall 22 of container 12 where it forms a smooth inverted U-bend 36 and then extends downwardly via leg 38 terminating in an opening 40 which is at approximately the same level as the bottom of container 12.

The operation of the dispenser is apparent from FIG. 2. First, to be operative, the dispenser must be disposed in a body of liquid, such as a toilet tank, and the container 12 should be fully immersed therein so that the bend 36 in the siphon tube is beneath the normal high water line of the tank. As the water level in the flush tank rises above the inverted U-bend 36 in the siphon tube, water flows into the container 12 through the opening 40 at the bottom of siphon tube 32 and the siphon tube itself and enters the container 12 with a rush. Incoming water will fill the container and also at least that portion of the air vent 28, which is below the highest point 36 of the siphon. The operation of the dispenser will not be adversely affected if the high water level is above the top 42 of air vent 28, although trace amounts of chemical solution formed in the dispenser may thereby be leached into the surrounding tank water in the interval between flushes.

When the tank water level falls, as for example, in response to the flushing of a toilet, the dispenser will immediately begin to drain through siphon tube 32, thereby dispensing a portion of the chemical solution which was formed with incoming fresh water during the previous flush cycle. Dispensing of the active chemical ingredient solution will continue only until such time as the level of solution within the container 12 drops below deck 24 and entry/exit port 34 in the deck 24 which is in fluid communication with siphon 32. Accordingly, the volume of active solution delivered to the tank during any flush cycle will be exactly fixed by the volume of the container which is above the deck 24, i.e., the upper chamber of the container defined by the upper walls, side walls, and top wall of the container and dotted line 43 in FIG. 2.

The location of the upper end 42 of air vent tube 28 is critical to the proper operation of the dispenser 10, since the dispenser will not operate properly unless the upper end 42 of the air vent tube 28 is higher than the inverted U-bend 36 in the siphon tube. If the air vent is at the same level as the siphon U-bend or lower, the dispenser may fill through the vent tube, leaving the siphon tube gas-bound and inoperative because of entrapped air bubbles. In addition, the vent tube must be of sufficient diameter to permit air to escape from container 12 through air vent tube 28 at a volumetric rate which is at least about equal to the volumetric rate at which water enters the container through siphon tube 32. By way of example, in a preferred embodiment, a dispenser sized for a conventional toilet tank might have an upper chamber volume in the range of 5 to 100 milliliters and a siphon tube of at least 1/32 inch in cross-sectional width. In such a dispenser, proper filling through the siphon tube would require that the top of the air vent tube 42 extend at least $\frac{1}{2}$ inch, preferably about $\frac{3}{4}$ inch, above the U-shaped bend in the siphon tube.

The location of the siphon tube 32, and particularly the inverted U-shaped bend 36 in the siphon, in relation to the upper chamber of container 12, is also significant to the proper functioning of the dispenser. Unless the U-shaped bend 36 is above the top wall 22 of container 12, the siphon 32 will facilitate extensive and continuous flow of chemical solution to the surrounding tank water during the period between flushes. Such flow negates the desired metering function of the dispenser and also allows premature mixing when mutually reactive ingredients, such as surfactants, colorants, and disinfectants, are simultaneously dispensed from separate containers of a dual dispenser. The activity of the chemicals is then lost in the tank water rather then being delivered to the toilet bowl in an active form for cleansing, coloring and sanitizing purposes upon flushing. By locating the inverted U-bend 36 of the siphon 32 above the top wall 22 of container 12, the chemical solution within container 12 will not significantly flow into the surrounding tank water but rather will remain substantially isolated therefrom between flushes despite the absence of any valves, air locks, air traps or other devices in the siphon tube.

The size and cross-sectional shape of the siphon tube 32 is also highly important to proper operation of the novel chemical dispenser of the invention. This is due, in large part, to the fact that the water level rises quite slowly in a toilet tank when it is being refilled. If the siphon tube is too large in diameter, e.g., $\frac{1}{4}$ inch or greater, incoming water during the fill cycle will dribble over the lower part of the inverted U-bend 36, rather than filling the entire cross-section of siphon 32 with water. Dribbling can result in a failure to displace the air which is present in the siphon 32 at the completion of discharge from the dispenser in response to a change in the liquid level in the tank. If an air bubble is retained in the siphon 32, it might cause the tube to become gas bound and thereby prevent proper functioning of the siphon during subsequent flush cycles. The dribble-over effect does not occur in very small diameter siphon tubes, e.g., on the order of 1/16 inch or less in diameter. However, the discharge flow rate is then so slow that the dispenser may fail to discharge completely in the time available during emptying of the toilet tank. For the foregoing reasons, the overall size and shape of the siphon tube is selected with respect to the flow rate of liquid into and out of the toilet tank so as to permit plug flow of water throughout the cross section of the siphon tube, thereby substantially eliminating the possibility of forming air bubbles which would interfere with the proper operation of the siphon tube.

FIG. 2 also illustrates a problem which can be caused when solid chemicals which form solutions of hypochlorites, peroxides or other oxidants are employed in the dispenser 10. All such oxidizing chemicals and their solutions have a tendency to slowly and spontaneously decompose and evolve gases. In the periods between flushes, some of these gas bubbles may find their way into the inner end of the siphon tube at entry port 34. Such bubbles will eventually collect as a single large bubble at the highest point in the siphon tube, as illustrated by the air space 45 in the vicinity of inverted U-shaped bend 36 of siphon tube 32. If the bubble becomes large enough to fill much or all of the upper portion of the siphon tube, the siphon will be gasbound and the dispenser will no longer discharge a chemical solution to the surrounding tank water in response to a lowering of the water level in the tank.

Figure 1:
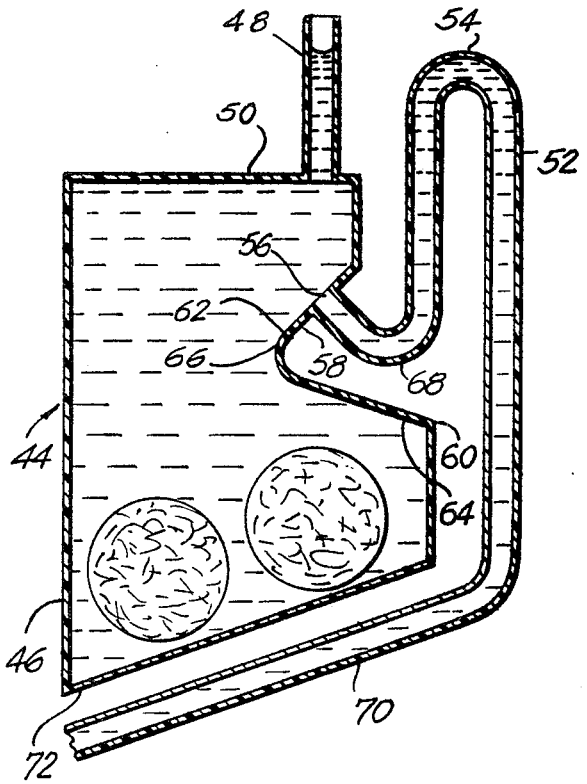
FIG. 1 is a schematic drawing of a chemical dispenser constructed in accordance with the invention.

The dispenser 44 illustrated in FIG. 1 includes structure which eliminates the gas-binding problem by making it physically difficult for any gas bubbles evolved by the chemical solution to reach the entry port of the siphon. Dispenser 44 includes a container 46, an air vent 48 which extends from and is in communication with the top of the container 50, and a siphon 52 having an inverted U-shaped bend 54 which communicates with the container through an entry port 56 in container 46. It will be readily apparent that the physical locations and relationships between the top of the container, the top of the air vent and the top of the U-shaped bend in the siphon tube are the same as described in connection with FIG. 2 and, accordingly, the dispenser will discharge a volume of solution equal to the volume of the upper chamber of the container 46 which lies above entry port 56 in response to a lowering of the level of the surrounding tank water and will take in a substantially equal volume of water from the surrounding tank water as it refills at the conclusion of the flush cycle.

Container 46 contains a modified sidewall structure which is designed to prevent gas binding and consists of a generally V-shaped indentation in side wall 60 of container 46. More specifically, side wall 60 consists of upper segment 62 and lower segment 64 which meet in a rounded but more or less V-shaped junction 66. The V-shaped indentation extends inwardly from the outermost edge of the container side wall far enough to accommodate the entry port 56 of the siphon tube. Entry port 56 to siphon 52 is located in upper wall segment 62 and faces in a generally upward direction. Accordingly, the V-shaped indentation acts as a deflection barrier which directs rising gas bubbles inward from the junction 66 and, therefore, away from entry port 56 of the siphon. Since the gas bubbles rise in a generally vertical direction, the geometry of the siphon entry port arrangement strongly favors the flow of gas bubbles through air vent 48, rather than entry port 56. Moreover, the fact that gas bubbles would have to flow in a downward direction to pass through entry port 56 and lower U-shaped bend 68 in the siphon tube further limits the likelihood of gas binding.

It will be readily apparent to those skilled in the art that numerous structural modifications can be made to dispenser 46, while still accomplishing the same desired functional result and that any form of side wall indentation, entry port location or combination thereof can be employed which results in the interruption of a straight flow path between the rising gas bubbles and the entry port, or which favors a bubble path preferentially leading to the air vent. For example, the entry port may be located above an indentation in the side wall of the container and face generally inward rather than upward, thereby relying primarily on the indentation rather than the direction in which the entry port faces to avoid gas binding.

The dispenser 44 of FIG. 1 also includes an extension of siphon 52 in the form of siphon tube arm 70 which wraps around the bottom 72 of container 46. While a siphon tube which merely extends below the entry port 56 to any degree can be used in the gas resistant dispenser of the invention, e.g., the siphon illustrated in FIG. 2 which extends to the level of the bottom of container wall 20, the longer tube of FIG. 1 is preferred. The larger volume of liquid in the longer siphon tube will assist in clearing any gas bubbles formed in the siphon.

To test the usefulness of the dispenser structure of the invention, two 10.5 g tablets of trichlorocyanuric acid were placed in the main compartments of dispensers constructed as shown in FIGS. 1 and 2. The two dispensers were completely immersed in separate containers of fresh water and left undisturbed for 48 hours. Gas evolution was observed from the tablets and solution in each dispenser almost immediately after immersion. Within an hour a small amount of this gas had found its way into the siphon tube of the dispenser of FIG. 2. The gas initially collected as a small bubble at the upper bend of the tube. At the end of one day, this bubble had expanded to fill most of both arms of the siphon 32 to the level of the inner tube end, as illustrated in FIG. 2. The dispenser siphon in this condition was found to be "gas bound" and inoperative when the external water level was lowered. The siphon tube of the dispenser shown in FIG. 1 was free of gas after one hour and one day. It contained a small gas bubble at the very top of the siphon tube after two days, but was fully functional upon lowering of the external water level.

Figure 3:
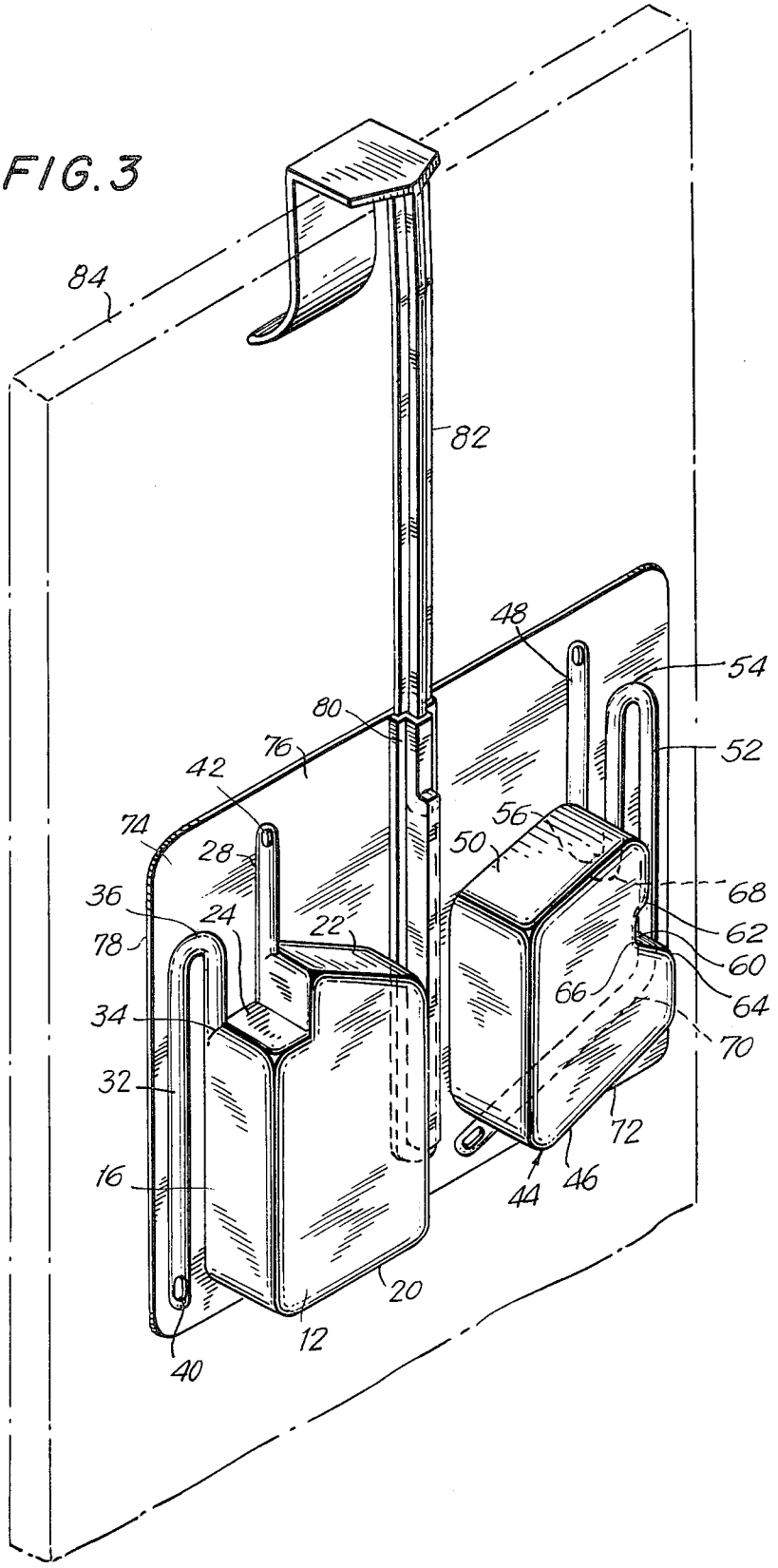
FIG. 3 is a perspective view of a preferred thermoformed, two-compartment dispenser constructed in accordance with the invention.

FIG. 3 is a perspective view of a preferred thermoformed dual dispenser 74 constructed in accordance with the invention. Such a dispenser is vacuum or pressure thermoformed to produce the desired dispenser configuration by disposing a thin sheet of thermoplastic material 76 over a mold cavity having the desired physical configuration of a dispenser and applying heat to the plastic sheet and a suitable vacuum to the mold cavity to achieve the desired shape. Thereafter, the desired chemicals are deposited in containers 12 and 50 and a suitable backing member 78 is laminated to thermoformed sheet 76 to complete the dual dispenser structure. The vacuum thermoforming technique may employ any thermoplastic film having sufficient strength, rigidity and chemical resistance to maintain its integrity under the conditions of intended use. The techniques for producing such thermoformed products are well known to those persons skilled in the art and do not form a part of the instant invention. Typical materials include polyvinyl chloride, styrene, etc., having a thickness of about 20 mils.

The dispenser on the left-hand side of FIG. 3 is substantially identical in both structure and function to the schematic drawing of FIG. 2 and, accordingly, similar parts have been designated with similar numerals. The overall shape of container 12, including, for example, the slant of top wall 22, does not affect the operation of the dispenser, except to change the volume of the upper chamber of the container 12 and, therefore, the volume of solution which will be discharged during each flush cycle.

The second dispenser 44, which is depicted on the righthand side of FIG. 3, is substantially the same in structure and operation to the schematic drawing of FIG. 1 and accordingly similar parts have been designated with similar numerals.

FIG. 3 also illustrates a vacuum formed sheath 80 and hanger 82 which together form the necessary structure for hanging the dual dispenser from the top edge of a toilet tank wall 84. The details of that novel hanger structure are described in copending, commonly assigned, application Ser. No. 455,973, filed in the names of Stanley Pilch and Elliott Subervi, on even date herewith and entitled "Improved Hanger for Chemical Dispenser", the disclosure of said application being hereby incorporated herein by reference.

In the preferred embodiment of the dispenser of the invention which is illustrated in FIG. 3, the left-hand container 12 is used to dispense a surfactant, colorant and odorant and the right-hand container 46 is used to dispense a disinfectant material. Any of the numerous materials of the foregoing type, which have been described in the prior art, are useful in the dispenser system of the present invention. Detailed descriptions of potentially suitable materials and formulations may be found, for example, in Kitko U.S. Pat. Nos. 4,200,606; 4,248,827; the prior art described in other parts of this disclosure; and an article by Herring, *Journal of Soap, Perfumery & Cosmetics,* Vol. 10, pp. 426–427 (1977), all of which are incorporated herein by reference.

It is understood that the forms of the invention illustrated herein are preferred embodiments and that various modifications can be made without departing from the spirit of the invention.

What is claimed is:

1. A chemical dispenser adapted to dispense a predetermined volume of a chemical solution into a body of liquid in which said dispenser is immersed in response to the level of said body of liquid being lowered from a first elevation to a second elevation, said dispenser comprising:

(a) a container holding both a quantity of a chemical in solid form and a chemical solution formed therefrom;

(b) an air vent in fluid communication with the upper portion of said container, said air vent extending upwardly and terminating above the top of said container;

(c) a siphon in fluid communication with said container for conveying a volume of said chemical solution from said container into said body of liquid in which said dispenser is immersed, said siphon commencing at an entry port in said container and extending therefrom to a point above the top of said container but below the top of said air vent and thereafter turning in a downward direction as a result of an inverted U-shaped bend therein to terminate at a point below said entry port in said container; and (d) an entry port for said siphon a deflection means, said entry port and deflection means being located in a side wall of said container below the top of said container and above said solid chemical and being so disposed that said deflection means will direct the path of rising gas bubbles in the solution surrounding said solid chemical away from said entry port;

whereby said siphon delivers a volume of chemical solution to said body of liquid in response to the level of said body of liquid being lowered from a first elevation to a second elevation and delivers a substantially equal volume of liquid from said body of liquid through said siphon to said container when said body of liquid is raised from said second elevation to said first elevation.

2. The dispenser of claim 1, wherein said entry port is tilted in an upward direction.

3. The dispenser of claim 2, wherein said siphon initially extends away from said entry port in a downward direction and thereafter rises through a bend and extends upwardly.

4. The dispenser of claim 1, wherein said container side wall includes an indentation, said entry port is located in the upper portion of said indentation and said solid chemical is located below the lower portion of said indentation.

5. The dispenser of claim 4, wherein said indentation has a generally V-shape and said entry port is located in the upper part of said V shape.

6. The dispenser of claim 1, wherein said siphon terminates at a point substantially level with the bottom of said container.

7. The dispenser of claim 1, wherein said siphon terminates at a point below the bottom of said container.

8. The dispenser of claim 1, wherein said siphon extends around and substantially parallels the bottom of said container.

9. A chemical dispenser adapted to dispense a predetermined volume of a chemical solution into a body of liquid in which said dispenser is immersed in response to the level of said body of liquid being lowered from a first elevation to a second elevation, said dispenser comprising:

(a) a container holding both a quantity of a chemical in solid form and a chemical solution formed therefrom;

(b) an air vent in fluid communication with the upper portion of said container, said air vent extending upwardly and terminating above the top of said container;

(c) a siphon in fluid communication with said container for conveying a volume of said chemical solution from said container into said body of liquid in which said dispenser is immersed, said siphon commencing at an entry port in said container and extending therefrom to a point above the top of said container but below the top of said air vent and thereafter turning in a downward direction as a result of an inverted U-shaped bend therein and extending around and substantially parallel to the bottom of said container; and (d) an entry port for said siphon located in a side wall of said container below the top of said container and above said solid chemical, said sidewall including an indentation and said entry port being so disposed with respect to said indentation that it is not in the direct path of rising gas bubbles in the solution surrounding said solid chemical;

whereby said siphon delivers a volume of chemical solution to said body of liquid in response to the level of said body of liquid being lowered from a first elevation to a second elevation and delivers a substantially equal volume of liquid from said body of liquid through said siphon to said container when said body of liquid is raised from said second elevation to said first elevation.

10. The dispenser of claim 9, wherein said indentation has a generally V-shape and said entry port is located in the upper part of said V-shape.

* * * * *